United States Patent [19]

Satake et al.

[11] Patent Number: 4,887,922

[45] Date of Patent: Dec. 19, 1989

[54] PAPER FEEDING DEVICE FOR PRINTERS

[75] Inventors: Atsushi Satake; Hajime Hirose, both of Chofu, Japan

[73] Assignee: Tokyo Juki Industrial Co., Ltd., Tokyo, Japan

[21] Appl. No.: 248,382

[22] Filed: Sep. 23, 1988

Related U.S. Application Data

[63] Continuation of Ser. No. 802,407, Nov. 27, 1985, abandoned.

[30] Foreign Application Priority Data

Nov. 30, 1984 [JP] Japan ..... 59-254777

[51] Int. Cl.[4] ..... B41J 13/036

[52] U.S. Cl. ..... 400/637; 400/636.3; 400/637.6

[58] Field of Search ..... 400/637.6, 613, 613.3, 400/616, 616.1, 616.3, 617, 618, 619, 636, 636.3, 637, 639.1, 641, 637.5

[56] References Cited

U.S. PATENT DOCUMENTS

| | | | |
|---|---|---|---|
| 2,978,088 | 4/1961 | Pearson et al. | 400/637.6 |
| 4,211,499 | 7/1980 | Hunt et al. | 400/637.6 |
| 4,215,945 | 8/1980 | Habich et al. | 400/637.6 X |
| 4,607,968 | 8/1986 | Carena | 400/637 |

*Primary Examiner*—Edgar S. Burr
*Assistant Examiner*—Huong Q. Pham
*Attorney, Agent, or Firm*—Morgan & Finnegan

[57] ABSTRACT

A paper feeding device for a printer provides presser rollers which are located on a normal line drawn from center of a platen to a tangential line drawn from circumference of a sprocket wheel to a platen circumference. Thus, papers are stiffened and stable paper feeding is maintained.

1 Claim, 2 Drawing Sheets

PAPER FEEDING DEVICE FOR PRINTERS

RELATED APPLICATIONS

This patent application is a continuation of U.S. Patent Application Serial No. 06/802,407, filed November 27, 1985, now abandoned.

BACKGROUND OF THE INVENTION

This invention relates to a paper feeding device for a printer and more particularly to a forced paper feeding device which is provided at the push side of a platen, is synchronized with the platen, and feeds papers employing sprocket holes and a tractor sprocket wheel.

A forced paper feeding device providing a tractor sprocket wheel which is located at the push side of a platen and is synchronized with the platen rotation is well-known. But in such a type of paper feeding device, although the papers are force fed, papers loaded over the platen are fed by friction between the platen and the paper (i.e., no force feed). Additionally, it is general practice that paper feeding by the platen is set shorter than the forced paper feeding by the tractor since the friction coefficient between the paper and the platen varies and the diameter of the platen changes due to its environmental condition. Thereby, the papers loaded over the platen are sometimes loosened. Because of such loosened papers, feeding by the platen is reduced and line spacing is shortended accordingly. If such a condition continues, the printing quality is lowered and additionally the printing causes noise due to the printing on the loosened paper.

SUMMARY OF THE INVENTION

It is an object of this invention to eliminate the above-described conventional limitations and to provide an improved paper feeding device for printers.

To solve the aforementioned problems of the prior art, this invention provides a presser device which presses the paper against the platen and is located at an intersection where a tangential line connecting circumference of the tractor and circumference of the platen intersects with a normal line drawn from a center of the platen to said tangential line.

DETAILED DESCRIPTION OF THE DRAWINGS

Referring to the accompanied drawings, one embodiment of the present invention will be explained. This embodiment is arranged to be applicable for two kinds of paper feeding: One using papers without sprocket holes (not shown on drawings) and the other using papers with sprocket holes wherein papers are force fed by the sprocket holes.

Figure 1A:
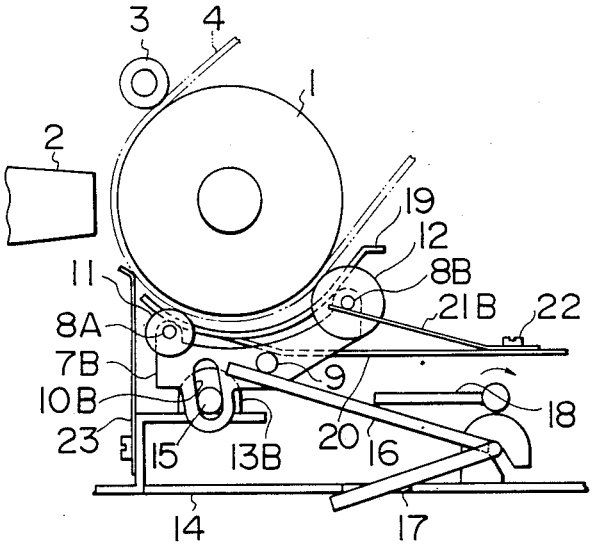
FIG. 1A is a partial section view of a paper feeding mechanism where a paper without sprocket holes is used.
Figure 1B:
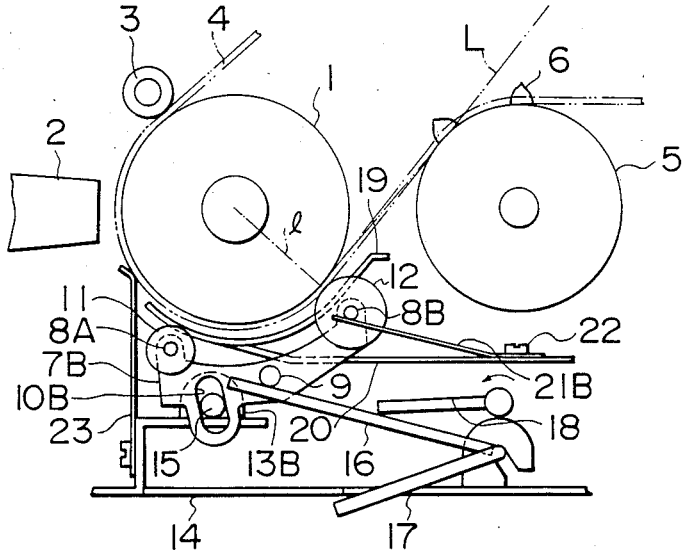
FIG. 1B is a partial section view of forced paper feeding mechanism where a paper with sprocket holes is used and a forced paper feed mechanism is provided at the push side of a platen.
Figure 2:
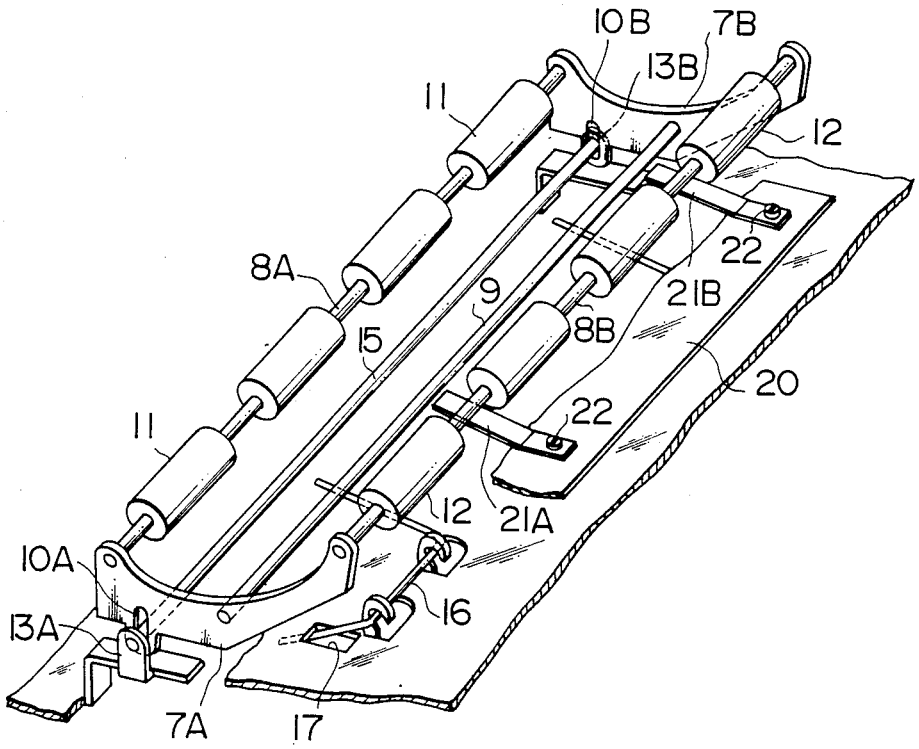
FIG. 2 is a perspective view of a presser roller mechanism provided around a platen.

Referring to FIGS. 1A and 1B, numeral 1 denotes a platen rotated in connection with a driving source. Numeral 2 denotes a printer head which located facing against surface of the platen 1. Numeral 3 denotes a bail roller which presses papers 4 against the upper side of the platen and is rotated by the platen 1. Numeral 5 is a tractor sprocket wheel which provides sprockets 6 about its circumference and these sprockets engage with sprocket holes on the paper. The tractor is interlocked with rotation of the platen 1, and the feeding length by the tractor is set to be equal to feeding length by the platen.

Numerals 7A, 7B denote a pair of roller support sheets facing each other. These support sheets sustain rollers, with sustaining shafts 8A, 8B running in parallel with axial line of the platen 1 and provide a spring-stopper shaft 9 at their middle portion of the roller support sheet. At the left side (refer to FIGS. 1A and B) of the support sheet, vertically oblong holes 10A, 10B are formed. The sustaining shaft 8A provides several presser rollers 11 which are facing against the platen 1. The sustaining shaft 8B provides several presser rollers 12 which are facing against the platen 1.

Numerals 13A, 13B are a pair of bearings, and are formed by bending up a portion of frame 14 to face each other. These bearings 13A, 13B sustain a shaft 15 which extends through the oblong holes 10A 10B provided at the support sheet respectively.

Numeral 16 denotes a torsion spring whose one end is engaged in a hole 17 and whose other end is engaged with the low side of the spring-stopper shaft 9. Employing torsional force of the spring 16, the roller support sheets 7A, 7B are lifted upward as a unit body through the spring-stopper shaft 9. Thus, the presser rollers 11, 12 are pressed against circumference of the platen 1 as FIG. 1A illustrates.

Referring to FIG. 1B, the presser roller 12 is positioned on the normal line "l" drawn from center of the platen to the tangential line "L" connecting circumference of the tractor sprocket wheel 5 and circumference of the platen 1. Numeral 18 denotes a switch tip of a switch lever (not shown) which is sustained rotatably at the frame 14.

Referring to FIGS. 1A and 1B, the end of the switch tip 18 positions on upside of the torsion spring 16. Numeral 19 denotes a paper guide which is positioned around the circumference of the platen curving as circular arc, and some portion of the paper guide is bent and projected horizontally forming a spring seat 20.

Numerals 21A, 21B denote plate springs which compose the presser device partially, and their base are fixed to upper-side of the spring seat 20 by a screw 22, and their ends are elastically contacting with the bottom of the roller-sustaining shaft 8B which sustains the presser roller 12. Thus, the roller sustaining shaft 8B is urged to be lifted up.

The above-described structure of this invention and its operation will be explained hereinafter. Referring to FIG. 1A, in this printing apparatus comprising the platen and the print head, the paper without sprocket holes or cut-paper (i.e., ordinary paper) is used (frictional feed). In such a case, a switch lever (not shown) is manually operated to rotate the switch tip 18 clockwise as an arrow illustrates and is stopped. By this operation, the torsion spring 16 lifts up the spring-stopper shaft 9 and a pair of roller support sheets 7A, 7B are raised since the oblong holes 10A, are lifted and guided by the shaft 15.

As the roller sheets 7A, 7B lift up, the presser rollers 11, 12 press the circumference of the platen 1 by the torsion spring 16 as FIG. 1A illustrates. Under such a condition, the papers 4 loaded over the platen 1 is pressed by the presser roller 11, 12 and is printed by the print head.

FIG. 1B illustrates a printing apparatus comprising the platen and the printing head and, in this apparatus, the forced feeding mechanism employing the papers having sprocket holes and the tractor sprocket wheel is applied. When such a paper feeding apparatus employing the sprocket wheel 5 is applied, the switch lever (not shown) is manually operated to rotate the switch tip 18 counter-clockwise as an arrow in FIG. 1B illustrates and the switching lever is stopped. By this rotation, end of the torsion spring is pressed downwardly by the switch tip 18, and the lifting force by the spring stopper shaft 9 is left inactive.

As the lifting force by the torsion spring 16 is inactive, the roller support sheets 7A, 7B which are supporting the presser roller tend to move downwardly as a whole unit by their gravity. But, since the plate springs 21A, 21B are lifting up the sustaining shaft 8B, the sustaining shaft 8B still continues to press the circumference of the platen 1 by its plate springs 21A, 21B without moving downwardly.

Referring to FIG. 1B, the left side portion of the roller-support sheets 7A, 7B move downwardly by their gravity, and the oblong holes 10A, 10B move downwardly guided by the shaft 15 until the spring-stopper shaft 9 contacts with the torsion spring 16. Thus, the presser roller 11 separates from circumference of the platen. In such a condition, the platen 1 and the tractor sprocket wheel 5 rotate in synchronized motion keeping approximately equal feeding pitch, and the paper is fed from the circumferential end of the tractor sprocket wheel 5 to the platen 1.

The paper 4 fed from circumferential end of the tractor sprocket wheel 5 to the platen is keeping a straight line path until it reaches to the contact point between the platen 1 and the presser roller 12. This line constitutes a tangential line drawn at circumference of the platen 1. Thereby, the paper 4 fed from the tractor-sprocket wheel to the platen is not bent during its path way. The paper is fed securedly, taking advantage of stiffness of the paper, to the contact point between the platen 1 and the roller 12.

After being fed into the contact point, the paper 4 is pressed by the presser roller 12 and the bail roller 3 against the platen 1, and is fed by rotation of the platen 1. The above-decribed paper feeding and printing by the print head 2 are performed in turns, and thus continuous printing against the paper is performed.

In this embodiment, the plate springs 21A, 21B press the sustaining shaft 8B, and consequently the roller 12 presses the platen. As another embodiment, it is possible to eliminate the roller 12, and instead of roller 12, the tip ends of the plate springs 21A, 21B are positioned at same point as the contact point between the roller 12 and the plates 1. Thus, these tip ends press the circumference of the platen 1, and the paper 4 is pressed against the platen 1 by elasticity of the plate springs 21A, 21B.

As described above, in the printing apparatus providing a forced paper feeding mechanism, the paper pressing device is positioned at the intersection between the line drawn tangentially from circumference of the tractor sprocket wheel to the circumference of the platen tangentially and the normal line drawn from center of the platen to said line, and the paper pressing device presses the paper fed from the paper feeder (sprocket wheel) against the platen. Accordingly, in this invention, the paper fed from the tractor sprocket wheel is transferred to the platen taking advantage of the stiffened paper 4 and the paper is then loaded over the platen 1. In this case, paper is tightly loaded over circumference of the platen 1, and is fed enabling accurate line spacing, eliminating loosened contact between the paper 4 and the platen 1, resulting in higher quality of printing. Additionally, elimination of the loosened contact lowers printing noise. Moreover, the forced and accurate paper feeding mechanism employing the tractor sprocket wheel is effective to make the total size of the apparatus minimal so as to be compactly constructed.

As many apparently widely different embodiments of the invention may be made without departing the spirit and scope therein, it is to be understood that invention is not limited to the specific embodiment thereof except as defined in the appended claims.

What is claimed:

1. In a printing apparatus including a frame, an intermittently rotating platen with a paper thereon, a printing device, and a tractor unit which forcedly transfers a paper to the platen in synchronization with platen rotation using sprocket holes in the paper, said printing apparatus comprising:

(a) a shaft fixed beneath and in parallel with a platen;

(b) a pair of roller support sheets, one placed beneath each end of the platen, said sheets each having an oblong hole for slidably receiving said shaft, and supporting therebetween two sustaining shafts, each with at least two presser rollers rotatably thereon, and said sheets holding therebetween a spring-stopper shaft running parallel to said two sustaining shafts;

(c) a torsion spring with one end fixed to said frame and another end engaged with said spring-stopper shaft such that said torsion spring tends to bias said pair of roller-support sheets upward and said presser rollers against the circumference of said platen;

(d) a plate spring with one end fixed to said frame and another end engaged with one of said sustaining shafts such that said presser rollers are lifted upward against the platen; and (e) a switch lever with one end rotatably sustained at said frame and another end engaged with said torsion spring;

wherein turning said switch lever in one direction causes said torsion spring to engage with said spring-stopper shaft such that said presser rollers press the platen, and turning said switch lever in another direction causes said torsion spring to disengage from said spring-stopper shaft such that one of said at least two presser rollers disengages from the platen but another of said at least two presser rollers is maintained against the platen by the plate spring.

* * * * *